US007762896B2

(12) United States Patent
Gaughan

(10) Patent No.: US 7,762,896 B2
(45) Date of Patent: Jul. 27, 2010

(54) METHOD AND APPARATUS FOR PRODUCING OPTICAL ILLUSIONS

(76) Inventor: John Gaughan, 5223 San Fernando Rd., Los Angeles, CA (US) 90039

( * ) Notice: Subject to any disclaimer, the term of this patent is extended or adjusted under 35 U.S.C. 154(b) by 892 days.

(21) Appl. No.: 11/639,470

(22) Filed: Dec. 14, 2006

(65) Prior Publication Data

US 2008/0146356 A1 Jun. 19, 2008

(51) Int. Cl.
*A63J 5/00* (2006.01)
*A63G 31/00* (2006.01)

(52) U.S. Cl. ..... 472/63; 472/75

(58) Field of Classification Search ..... 472/57, 472/61, 63, 75–84, 136; 52/36, 60, 61
See application file for complete search history.

(56) References Cited

U.S. PATENT DOCUMENTS 221,605 A 11/1879 Pepper et al.
700,381 A 5/1902 Sherman
1,099,852 A * 6/1914 Kibley ..... 472/77
1,699,345 A 1/1929 Chandlee
1,888,320 A * 11/1932 Hudiakoff ..... 472/77
2,155,767 A 4/1939 Pfannekuchen
4,233,767 A * 11/1980 Hryhorczuk ..... 40/453
5,346,433 A * 9/1994 Weinreich ..... 472/63
5,855,520 A * 1/1999 Gitter et al. ..... 472/63
5,871,404 A * 2/1999 Weinreich ..... 472/63
6,623,366 B2 9/2003 Fiedler

* cited by examiner

*Primary Examiner*—Kien T Nguyen

(57) ABSTRACT

A method and apparatus for use in connection with a theatrical stage presentation for rendering an actor or object located on the stage visible or invisible at will. The apparatus used to create the illusion includes a strategically located, selectively transparent screen and a large, generally vertically extending mirror. In carrying out the method of the invention, the mirror is controllably moved across the stage at a location intermediate a rear wall and the selectively transparent screen from a first position out of sight of the audience to a second position wherein the mirror is disposed between the rear wall and the selectively transparent screen.

14 Claims, 7 Drawing Sheets

14
24

6
6
14
26
30
14

28
24
14

METHOD AND APPARATUS FOR PRODUCING OPTICAL ILLUSIONS

BACKGROUND OF THE INVENTION

1. Field of the Invention

The present invention relates generally to theatrical productions. More particularly, the invention concerns a method and apparatus for producing optical illusions.

2. Discussion of the Prior Art

A number of methods and apparatus for producing optical illusions have been suggested in the past. A very early apparatus of this type was disclosed by Pepper and Walker in U.S. Pat. No. 221,605 that was first patented in England in March of 1879. Pepper and Walker suggested an arrangement of apparatus to render an actor or object gradually visible or invisible at will and also to substitute for an object in the sight of the audience the image of another similar object hidden from direct vision without the audience being aware that any such substitution had been made. At the heart of the Pepper and Walker apparatus was a large plate of glass which was transparent and more and more densely silvered in passing from one end toward the other end. The plate glass was placed diagonally across the stage so that as it was advanced the glass obscured the view of the actor or object in front of which it passed and substituted the reflection of an object in front of the glass, but suitably concealed from the direct view of the audience.

In recent years, a number of different types of apparatus have been suggested for performing optical illusions both on stage and in the media of television and motion pictures. These apparatus tend to be quite elaborate and are typically complex and usually quite expensive. The thrust of the present invention is to provide a method and apparatus for performing optical illusions that is of a simple construction and one that can be relatively inexpensively constructed and easily set up for performing optical illusions on a conventional theatrical stage. However, the apparatus can be readily adapted for use in other performing media.

SUMMARY OF THE INVENTION

By way of brief summary, a principal object of the present invention is to provide a method and apparatus for use in connection with a theatrical stage presentation for rendering an actor or object located on the stage visible or invisible at will.

In one form of the apparatus of the invention a strategically located, selectively transparent screen and a large, generally vertically extending mirror are used to create the illusion. In accordance with one form of the method of the invention the mirror is controllably moved across the stage at a location intermediate a rear wall and the selectively transparent screen from a first position out of sight of the audience to a second position wherein said mirror is disposed between the rear wall and the selectively transparent screen.

With the forgoing in mind, it is an object of the present invention to provide a method and apparatus for creating an optical illusion wherein actors or other objects on the stage are made to appear to magically vanish.

Another object of the invention is to provide an apparatus of the aforementioned character which is of a simple, straightforward construction and easy to set up and use.

Another object of the invention is to provide an apparatus as described in the preceding paragraphs which is relatively inexpensive and is adapted to be used on a conventional theatrical stage.

DESCRIPTION OF THE INVENTION

Figure 11:
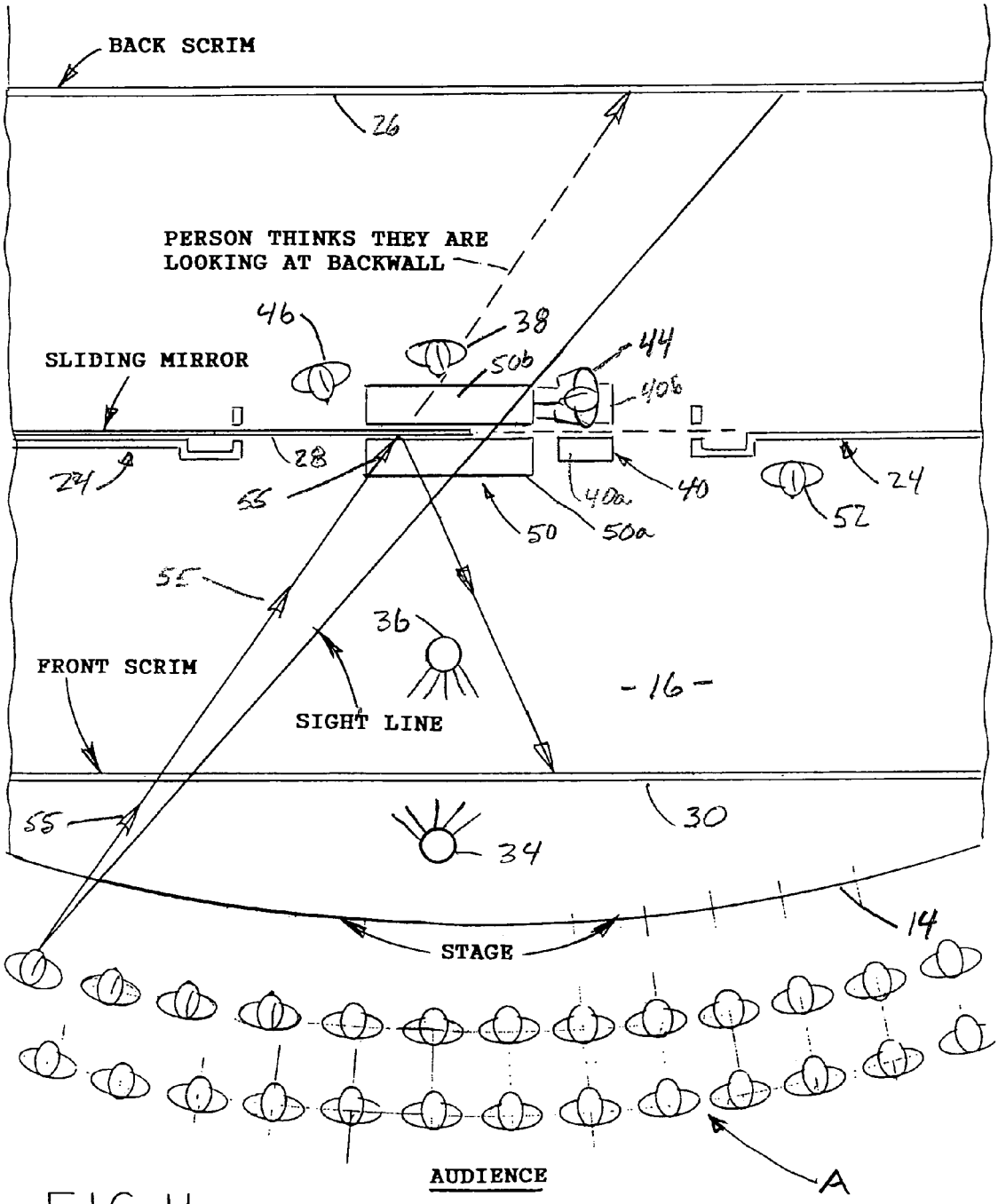
FIG. 11 is a generally diagrammatic, top plan view further illustrating the method of carrying out the illusion of the invention.

Referring to the drawings, and particularly to FIGS. 1 through 4, one form of the apparatus of the invention for performing an optical illusion can be seen to comprise a stage 14 that is viewable by an audience "A" (see also FIG. 11). As best seen by referring to FIG. 2, stage 14 has a width "W", a forward portion 16, a rear wall 18 and a transversely extending line 20 that is disposed between the forward portion 16 and the rear wall 18. The portion of the stage that is directly viewable by the audience is identified in FIG. 1 by the numeral 22 and is defined by a decorative superstructure 24 that is located proximate each side of the stage.

Figure 2:
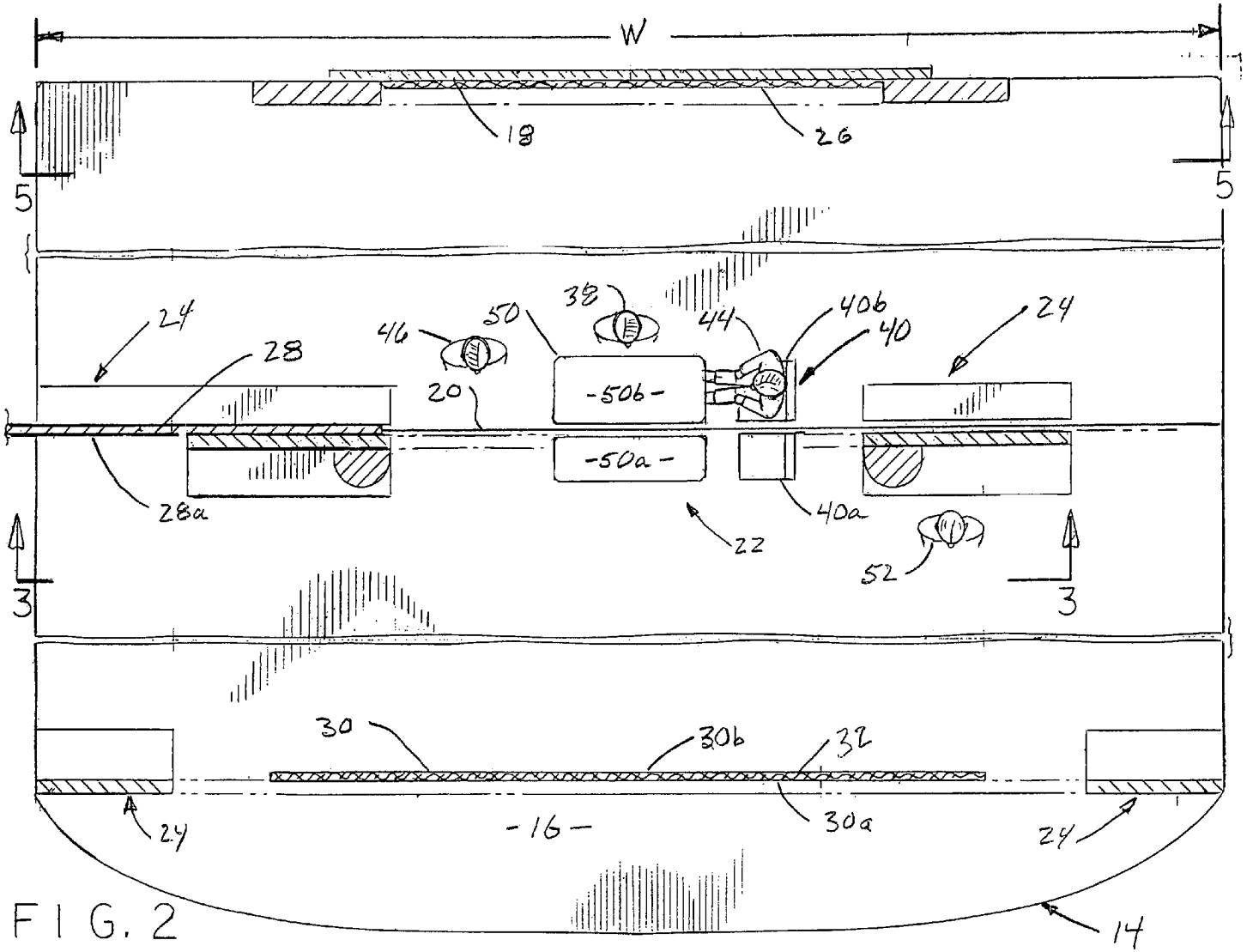
FIG. 2 is a cross-sectional view taken along lines 2-2 of FIG. 1.

As illustrated in FIG. 2, the rear wall 18 of the stage has a first image 26 formed thereon. This first image, which can be formed on the wall itself, or on a scrim panel, can comprise a decorative scene, a distinctive pattern, a particular texture, or similar image that is readily recognizable by the audience.

Disposed out of sight of the audience and partially behind a portion of the superstructure 24 is a generally vertically extending mirror 28. Mirror 28, which has a reflective front surface 28*a*, is controllably movable along transversely extending line 20 from a first position out of sight of the audience (see FIG. 2), to a second extended position (see FIGS. 7 and 8). Mirror 28, which is preferably relatively thin having a thickness of between about ¼ and about ⅜ inch, can be quickly and noiselessly moved across the stage by running it in guides and upon rollers or the like in a manner well understood by those skilled in the art.

Positioned between the audience "A" and the generally vertically extending mirror 28 is a selectively transparent, perforated screen, or scrim 30, which is of a character well known to those skilled in the art. Screen 30, which is maintained substantially parallel to mirror 28, has a front surface 30*a* and a rear surface 30*b* that is provided with a second image 32 that generally corresponds to the mirror image of the first image 26 that is formed on rear wall 18. More particularly, as will be discussed in greater detail in the paragraphs which follow, image 32 is formed on rear surface 30*b* of the scrim in a manner such that when the mirror 28 is moved across the stage and the image 32 is reflected from the front surface 28*a* of the mirror, the audience will believe that they are at all times seeing the rear wall of the stage rather than the reflection of the image formed on the scrim 30.

For a purpose presently to be described, the apparatus of the present embodiment of the invention further includes first and second light sources 34 and 36 that are mounted on the stage superstructure in a manner to selectively illuminate the stage and the front and rear surfaces 30*a* and 30*b* respectively of the screen 30 (see FIG. 11).

Referring particularly to FIGS. 1, 2, 3 and 11, during the performance of the optical illusion, several objects of different character are strategically positioned on the stage. These objects here include a first object 38, depicted as a person that is positioned between the transversely extending line 20 and the rear wall 18 of the stage. A second object, here depicted as an article of furniture in the form of a chair 40 of unique design, is positioned at a location proximate the right side of the stage. Uniquely, chair 40 is bisected so that its first side portion 40*a* is disposed on one side of the transversely extending line 20 and its second side portion 40*b* is disposed on the opposite side of the transversely extending line 20.

Figure 10:
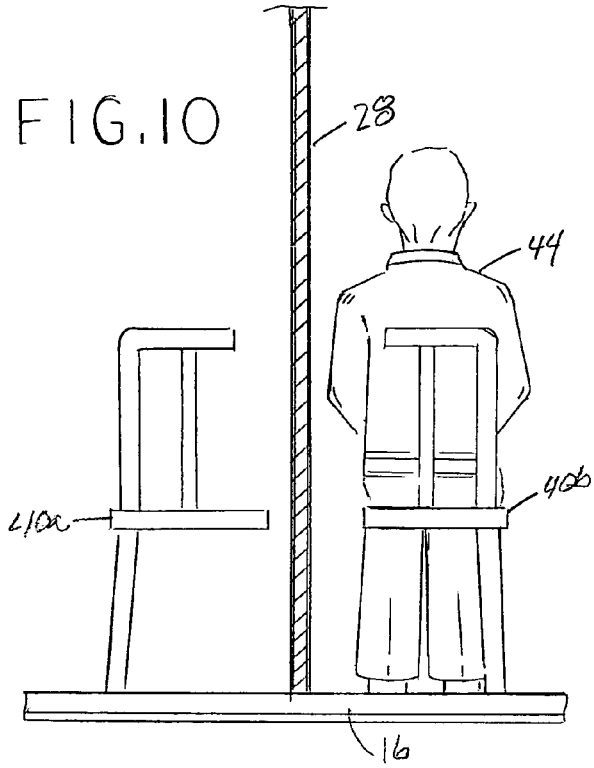
FIG. 10 is an enlarged cross-sectional view taken along lines 10-10 of FIG. 8.

As best seen in FIGS. 2 and 10 of the drawings, a third object is here depicted as a person 44 sitting on the second side portion of the chair. It is to be observed that in this position the person is located between the transversely extending line 20 and the rear wall 18. A fourth object, also shown as a person 46, is positioned proximate the left side of the stage and between the transversely extending line 20 and the rear wall 18. As illustrated in FIG. 11, person 46 will be hidden from the view of the audience when the mirror 28 is advanced to the position shown in FIG. 11.

Also positioned on the stage proximate the central viewing area is a fifth object that here comprises a table 50. Table 50, which is of the unique bisected construction best seen in FIGS. 2, 9 and 11, includes a first portion 50*a* disposed on one side of the transversely extending line 20 and a second portion 50*b* disposed on the opposite side of the transversely extending line. A sixth object, here depicted as a person 52, is positioned proximate the right-hand portion of the stage in a manner illustrated in FIG. 2 of the drawings.

Figure 1:
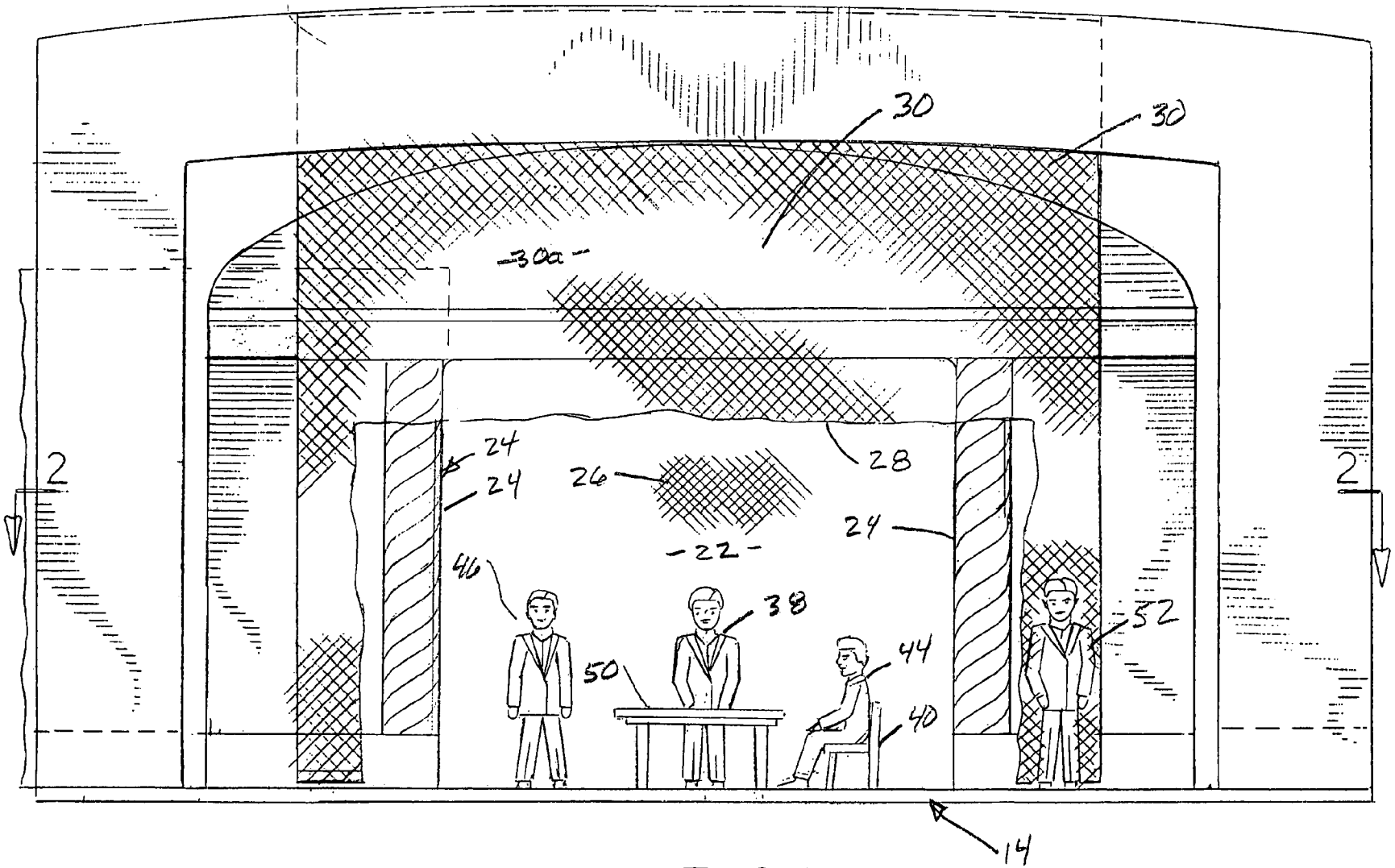
FIG. 1 is a front view of the theatrical stage upon which the illusion is performed.
Figure 3:
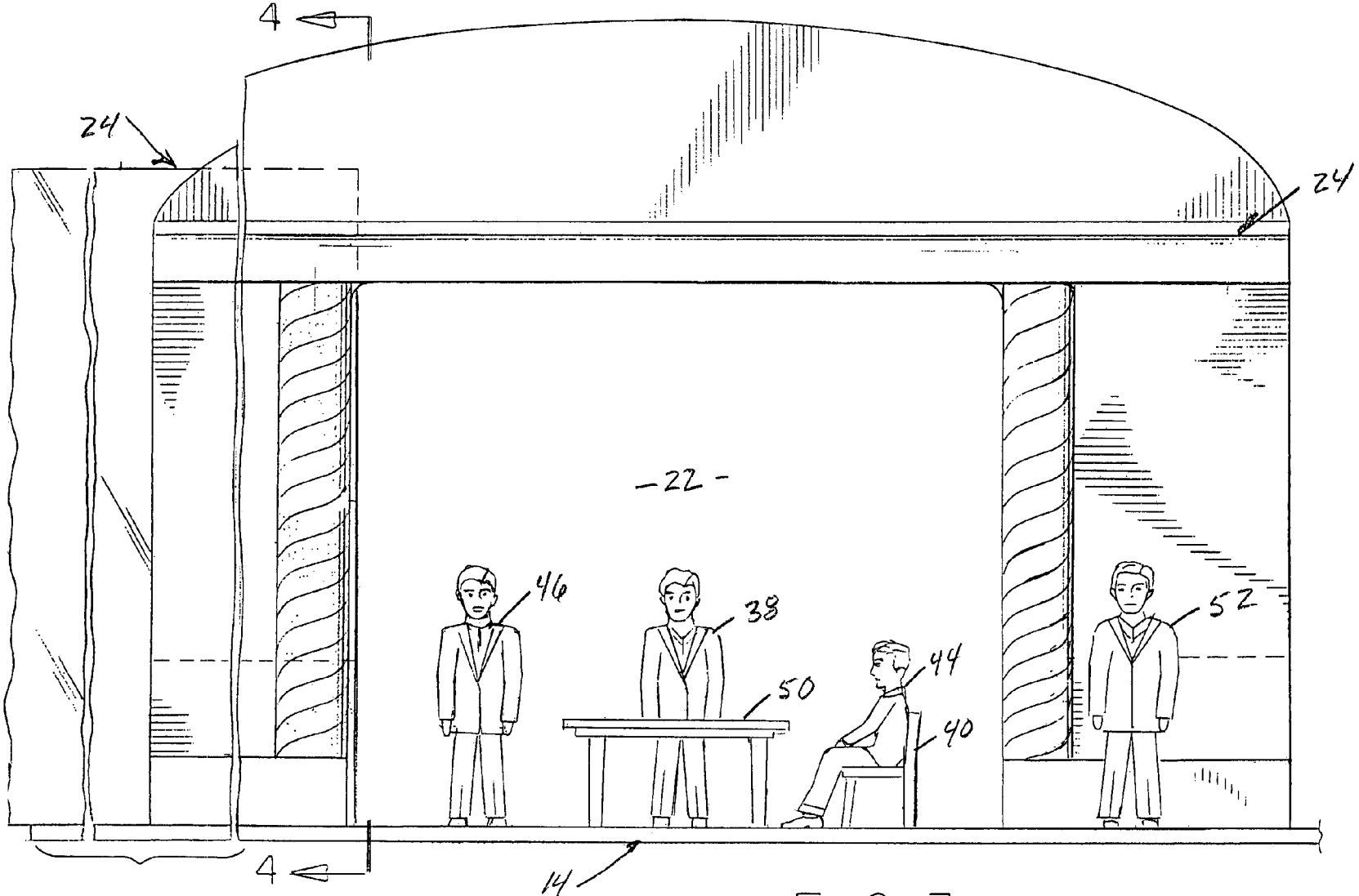
FIG. 3 is a view taken along lines 3-3 of FIG. 2.
Figures 4, 5, 6:
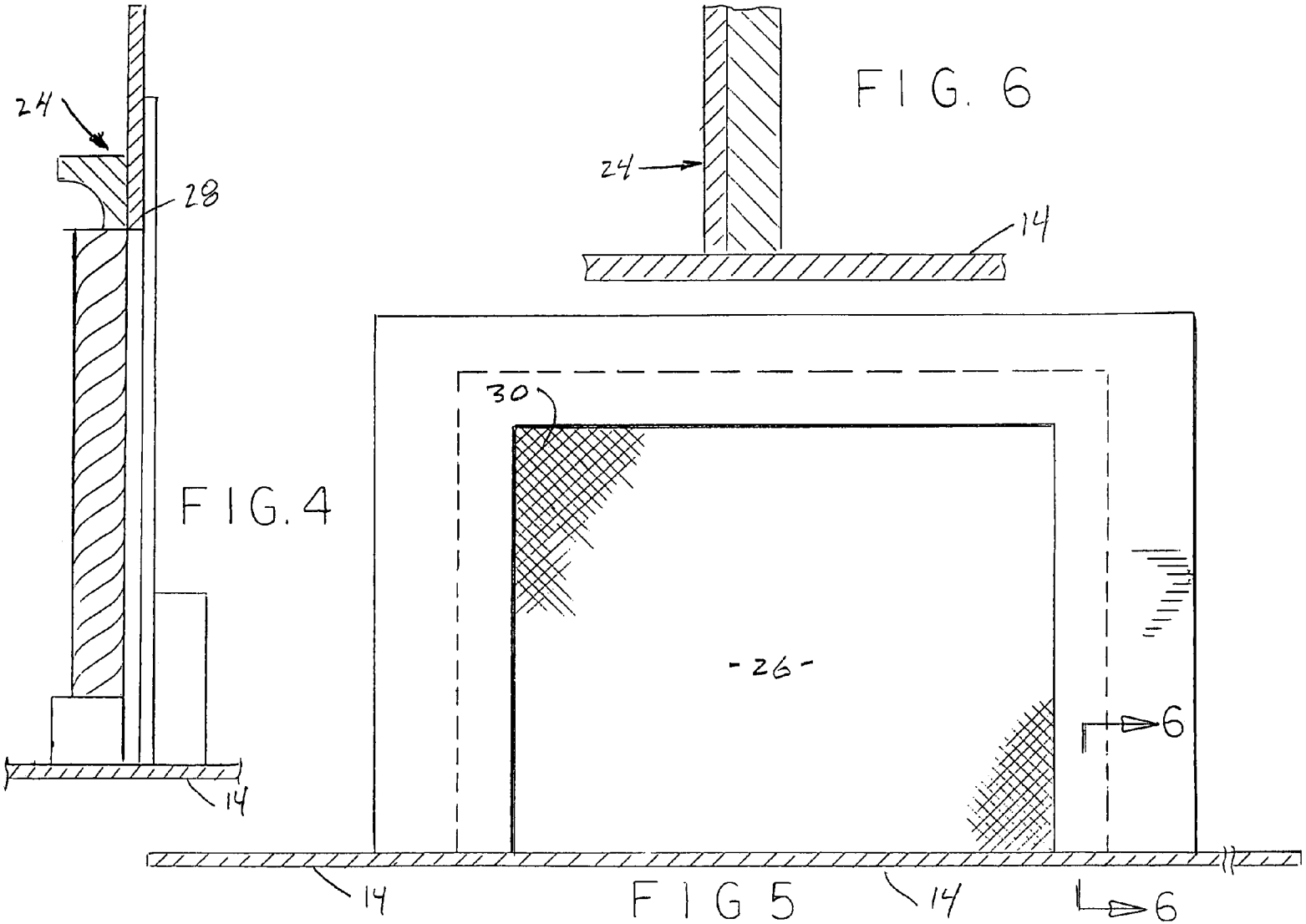
FIG. 4 is a cross-sectional view taken along lines 4-4 of FIG. 3.
FIG. 5 is a view taken along lines 5-5 of FIG. 2.
FIG. 6 is an enlarged cross-sectional view taken along lines 6-6 of FIG. 5.

In carrying out one form of the method of the invention for performing the optical illusion, the theatrical stage is first arranged in the manner shown in FIGS. 1, 2 and 3 of the drawings. In this starting configuration, the mirror 28 is hidden from the view of the audience by the superstructure 24 (see particularly FIG. 2). Additionally, the selected first image 26 has been appropriately formed on the rear wall 18 and the second image 32 that corresponds thereto has been formed on surface 30*b* of the scrim, or perforated panel 30.

As is well understood by those skilled in the art, the scrim 30, which is typically constructed from a perforated fabric or the like, appears opaque when front lighted and transparent or translucent when back lighted. Accordingly, in carrying out the method of the invention, when light 34 is illuminated, the scrim will appear opaque to the audience. However, when light 34 and the stage 16 are illuminated, the scrim will appear substantially transparent to the audience and the audience will see the image on the rear wall 18 as well as the various objects on the stage in front of the rear wall.

Figure 9:
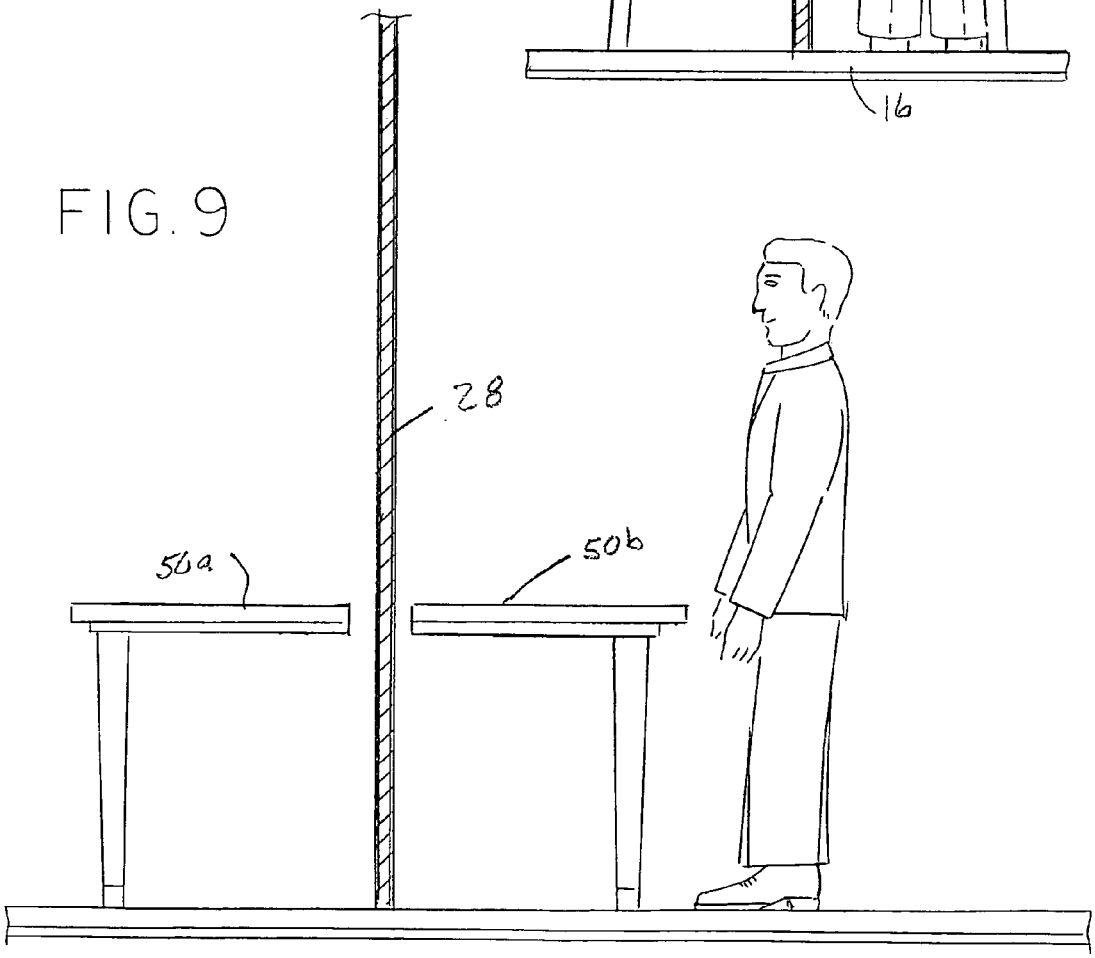
FIG. 9 is an enlarged cross-sectional view taken along lines 9-9 of FIG. 8.

Referring to FIGS. 9 and 11, when the mirror is advanced to the position there shown, the audience will see the reflection in the mirror of the image 32 on the front scrim and a portion of the table 50 (see the arrows 55). However, because the reflected image formed on the scrim is substantially identical to the image 26 formed on the rear wall and because the table is bisected to receive the mirror, the audience will think they are still seeing the image 26 formed on the rear wall 18. This uniquely creates the illusion that persons 46 and 38 have mysteriously disappeared.

Figure 7:
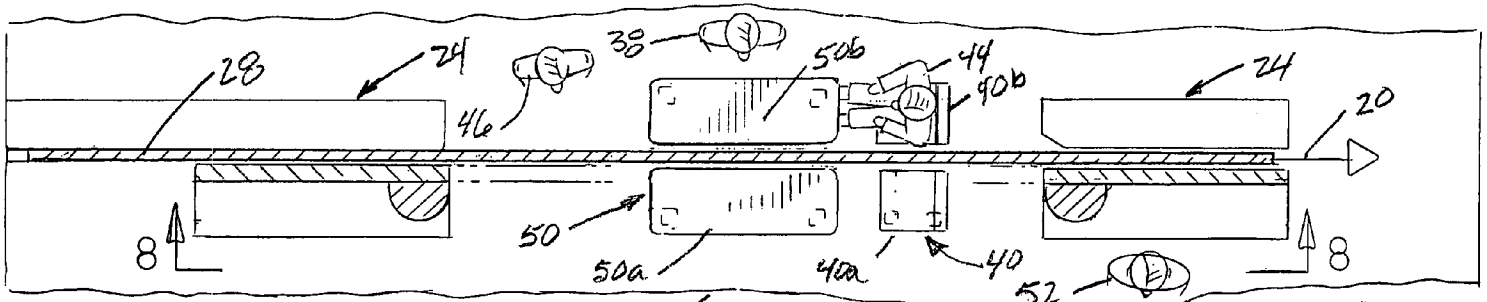
FIG. 7 is a fragmentary view similar to the central portion of FIG. 2 but showing the mirror having been moved from the left side of the stage to the right side of the stage.
Figure 8:
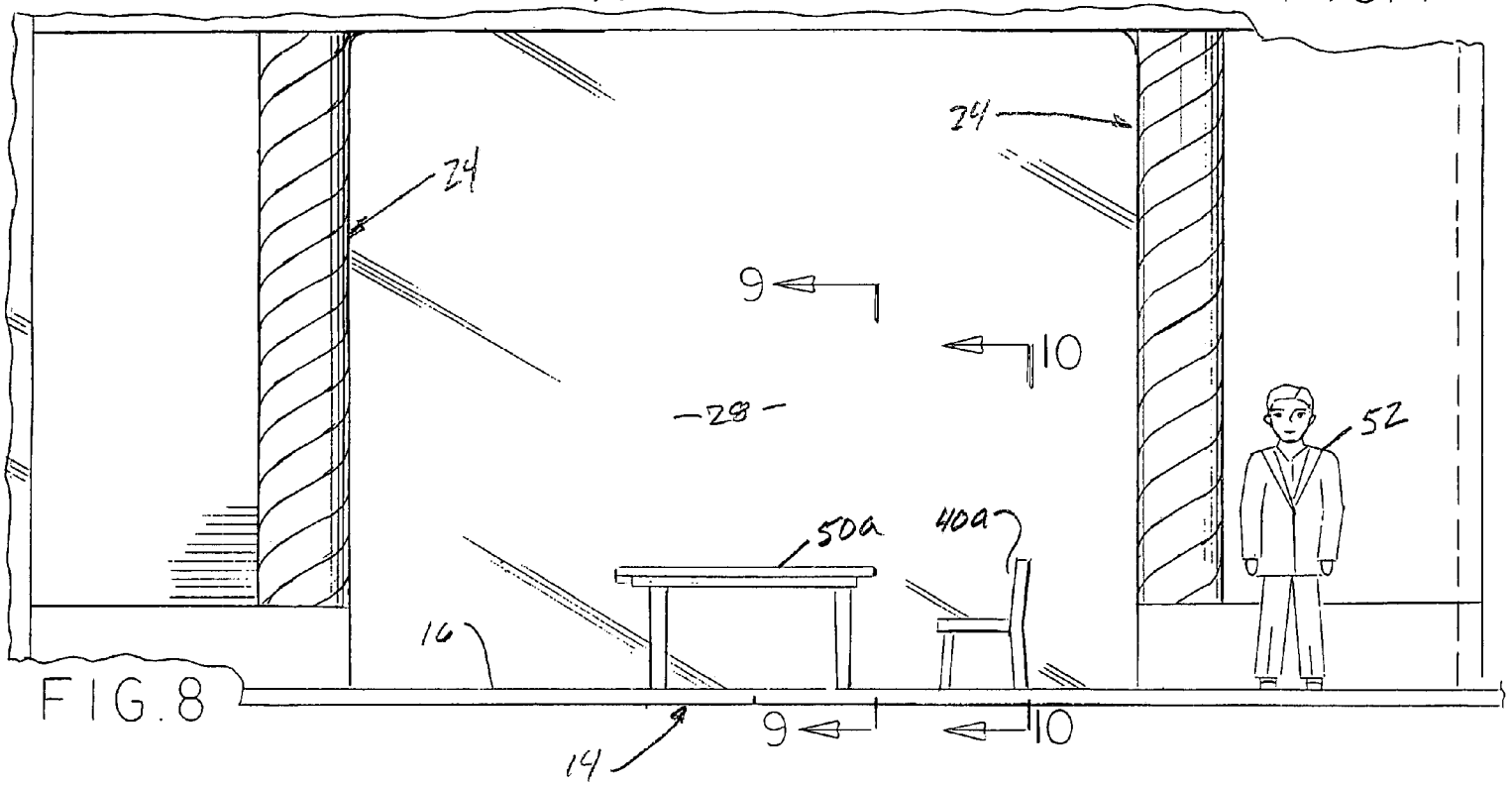
FIG. 8 is a view taken along lines 8-8 of FIG. 7.

When the mirror is further advanced along the transversely extending line 20 from the position shown in FIG. 11 to the advanced position to the position shown in FIGS. 7 and 8 of the drawings, the audience will see the reflection in the mirror of the front portion 50*a* of the table 50, the front portion 40*a* of the chair 40 and the complete image 32 formed on the front scrim as reflected by the mirror. Once again, because the reflected image formed on the scrim is substantially identical to the image 26 formed on the rear wall and because both the table and chair are uniquely bisected to receive the mirror in the manner shown in FIG. 7, the audience will think they are still seeing the table and chair disposed in front of the image 26 formed on the rear wall 18 (see also FIGS. 8, 9 and 10). This uniquely creates the illusion that persons 46, 38 and 44 have all mysteriously disappeared, but the table and chair have remained. Person 52, who is in front of the superstructure 24, will, of course, remain visible, thereby further enhancing the illusion.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for performing an optical illusion before an audience wherein actors or objects appear to vanish and appear at will, said apparatus comprising:

(a) a stage viewable by the audience, said stage having a width, a forward portion, a rear wall and a transversely extending line disposed between said forward portion and said rear wall, said rear wall having an image thereon;

(b) a selectively transparent screen disposed proximate said forward portion of said stage and between the audience and said rear wall, said selectively transparent screen having a front surface and a rear surface having an image thereon substantially corresponding to said image on said rear wall; and (c) a generally vertically extending mirror movable along said transversely extending line from a first position out of sight of the audience to a second position.

2. The apparatus as defined in claim 1, further including first and second light sources carried by said stage for illuminating said front and rear surfaces of said selectively transparent screen respectively.

3. The apparatus as defined in claim 1, further including a first object positioned on the stage and disposed between said transversely extending line and said rear wall of said stage.

4. The apparatus as defined in claim 1, further including a second object positioned on the stage, said second object having a first portion disposed on one side of said transversely extending line and a second portion disposed on the opposite side of said transversely extending line.

5. The apparatus as defined in claim 4, in which said first object is a person and in which said second object is a piece of furniture.

6. The apparatus as defined in claim 5, further including a third object positioned proximate said second object and between said transversely extending line and said rear wall.

7. The apparatus as defined in claim 6, further including a fourth object positioned on said stage proximate said second object and between said transversely extending line and said rear wall, whereby said fourth object is obscured by said mirror when said mirror is in said second position.

8. The apparatus as defined in claim 6, further including a fifth object positioned on said stage proximate said second object, said fifth object comprising a table having a first portion disposed on one side of said transversely extending line and a second portion disposed on the opposite side of said transversely extending line, whereby said second portion of said table is obscured by said mirror when said mirror is in said second position.

9. The apparatus as defined in claim 8, in which said mirror has a thickness of between about ¼ and about ⅜ inch.

10. An apparatus for performing an optical illusion before an audience wherein actors or objects appear to vanish and appear at will, said apparatus comprising:

(a) a stage viewable by the audience, said stage having a width, a forward portion, a rear wall and a transversely extending line disposed between said forward portion and said rear wall, said rear wall having an image thereon;

(b) a selectively transparent screen disposed proximate said forward portion of said stage and between the audience and said rear wall, said selectively transparent screen having a front surface and a rear surface, said rear surface having an image thereon substantially corresponding to said image on said rear wall;

(c) a generally vertically extending mirror movable along said transversely extending line from a first position out of sight of the audience to a second position;

(d) a first light source carried by said stage for illuminating said rear surfaces of said selectively transparent screen; and (e) a first object positioned on the stage and disposed between said transversely extending line and said rear wall of said stage.

11. The apparatus as defined in claim 10, further including a second object positioned on the stage, said second object having a first portion disposed on one side of said transversely extending line and a second portion disposed on the opposite side of said transversely extending line.

12. The apparatus as defined in claim 11, in which said first object is a person and in which said second object is a piece of furniture.

13. The apparatus as defined in claim 12, further including a third object positioned proximate said second of said second object and between said transversely extending line and said rear wall.

14. A method for performing an optical illusion before an audience viewing a theatrical stage having a width, a forward portion, a rear wall and a transversely extending line disposed between the forward portion and the rear wall, wherein an object located on the stage rearwardly of the transversely extending line appears to vanish, said method being performed using an apparatus comprising a generally vertically extending mirror movable along the transversely extending line from a first position out of sight of the audience to a second position, said method comprising the steps of:

(a) forming an image on said rear wall;

(b) erecting a selectively transparent screen proximate the forward portion of the stage at a location between the audience and said rear wall, said screen having a front surface and a rear surface;

(c) forming an image on said rear surface of said selectively transparent screen substantially corresponding to the image on the rear wall; and (d) moving the generally vertically extending mirror along the transversely extending line from the first position to the second position to obscure the object and to cause the audience to view the reflected image formed on said rear surface of said selectively transparent screen.

* * * * *